US010347965B2

(12) United States Patent
Hawaka et al.

(10) Patent No.: US 10,347,965 B2
(45) Date of Patent: Jul. 9, 2019

(54) ELECTRONIC APPARATUS WITH SHIELDED ANTENNA SPACE

(71) Applicant: LENOVO (SINGAPORE) PTE. LTD., Singapore (SG)

(72) Inventors: Shigekazu Hawaka, Yokohama (JP); Osamu Yamamoto, Yokohama (JP); Takaaki Okada, Yokohama (JP)

(73) Assignee: LENOVO (SINGAPORE) PTE. LTD., Singapore (SG)

( * ) Notice: Subject to any disclaimer, the term of this patent is extended or adjusted under 35 U.S.C. 154(b) by 0 days.

(21) Appl. No.: 15/699,672

(22) Filed: Sep. 8, 2017

(65) Prior Publication Data

US 2018/0375189 A1 Dec. 27, 2018

(30) Foreign Application Priority Data

Jun. 22, 2017 (JP) ..... 2017-122208

(51) Int. Cl.

| | |
|---|---|
| ***H01Q 1/22*** | (2006.01) |
| ***H01Q 1/52*** | (2006.01) |
| ***H01Q 1/48*** | (2006.01) |
| *H01Q 9/04* | (2006.01) |
| *H01Q 21/28* | (2006.01) |

(52) U.S. Cl.

CPC ..... *H01Q 1/2266* (2013.01); *H01Q 1/526* (2013.01); *H01Q 1/48* (2013.01); *H01Q 9/0421* (2013.01); *H01Q 21/28* (2013.01)

(58) Field of Classification Search

CPC ..... H01Q 1/2258; H01Q 1/2266; H01Q 1/48; H01Q 1/52; H01Q 1/526

See application file for complete search history.

(56) References Cited

U.S. PATENT DOCUMENTS 8,896,487 B2 * 11/2014 Chiang ..... G06F 1/1616 343/700 MS

FOREIGN PATENT DOCUMENTS

| | | | |
|---|---|---|---|
| JP | 2004-260647 | A | 9/2004 |
| JP | 2004260647 | A | 9/2004 |
| JP | 2013-162413 | A | 8/2013 |
| JP | 2013162413 | A | 8/2013 |
| JP | 2015-070307 | A | 4/2015 |

* cited by examiner

*Primary Examiner* — Daniel Munoz
*Assistant Examiner* — Patrick R Holecek
(74) *Attorney, Agent, or Firm* — Shimokaji IP

(57) ABSTRACT

The present disclosure provides an electronic apparatus having an antenna unit at a body chassis. The electronic apparatus includes: a body chassis; an antenna supporting member disposed in an antenna space at a periphery of the body chassis, and having an upper face on which an antenna pattern is formed, the antenna space being surrounded with a dielectric cover; a shield wall for the antenna space, including a conductive thin film covering an entire lateral face of the antenna supporting member close to a center of the body chassis, an upper antenna ground element connected to the conductive thin film and the rear face of a keyboard cover member, and a lower antenna ground element connected to the conductive thin film and the rear face of a bottom-face cover member. The conductive thin film, the upper antenna ground element and the lower antenna ground element define the shield wall.

2 Claims, 3 Drawing Sheets

ELECTRONIC APPARATUS WITH SHIELDED ANTENNA SPACE

FIELD OF THE INVENTION

The present invention relates to an electronic apparatus having an antenna unit at a body chassis, and the electronic apparatus can be compact and the antenna unit can keep good receiving characteristics.

BACKGROUND OF THE INVENTION

An electronic apparatus, such as a laptop personal computer (laptop PC), typically has various wireless communication functions as in wireless LAN (Local Area Network) or wireless WAN (Wide Area Network). An antenna unit for such wireless communication has to be disposed away from a conductor such as metal to have a certain space therebetween.

In order to keep the communication quality of the antenna unit of a laptop PC, the laptop PC typically includes an antenna unit at an upper end of the display chassis so that the antenna unit can be located at the uppermost part of the PC during use (see Patent Document 1, for example).

[Patent Document 1] Japanese Patent Application Laid-Open No. 2013-162413

SUMMARY OF THE INVENTION

Some of the electronic apparatuses may include such an antenna unit at the body chassis having a keyboard unit. This is for not reducing the size of the display screen while downsizing the electronic apparatus. In this case, the receiving characteristics of the antenna unit may deteriorate because the body chassis accommodates various types of electronic components, such as an arithmetic unit and a memory, which may be a noise source for the antenna unit. To avoid this, a shield wall has to be disposed between the antenna unit and a noise source in the body chassis so as to prevent electromagnetic noise from the noise source from transmitting to the antenna unit. Such a shielding wall, however, means an increase in size of the body chassis corresponding to the space required for the shielding wall, which makes the electronic apparatus as a whole larger.

In view of the above, the present invention aims to provide an electronic apparatus having an antenna unit at a body chassis, and the electronic apparatus can be compact and the antenna unit can keep good receiving characteristics.

In order to solve the above-stated problem and fulfill the aim, an electronic apparatus according to the first aspect of the present invention includes: a body chassis; and an antenna supporting member, the antenna supporting member having an upper face on which an antenna pattern is formed, the antenna supporting member being disposed in an antenna space at a periphery of the body chassis, the antenna space being surrounded with a dielectric cover. The electronic apparatus includes a shield wall for the antenna space, the shield wall including a conductive thin film covering an entire lateral face of the antenna supporting member close to a center of the body chassis.

In the electronic apparatus according to the second aspect of the present invention, the antenna supporting member is integrally formed as a three-dimensional circuit so as to include the antenna pattern on the upper face and the conductive thin film on the lateral face.

The electronic apparatus according to the third aspect of the present invention further includes a sheet-form upper antenna ground element connected to the conductive thin film, the upper antenna ground element extending from the conductive thin film toward a center part of an upper-face member of the body chassis to be connected to the upper-face member, wherein the conductive thin film and the upper antenna ground element define a shield wall for the antenna space.

In the electronic apparatus according to the fourth aspect of the present invention, the upper-face member is a conductive member.

The electronic apparatus according to the fifth aspect of the present invention further includes a sheet-form lower antenna ground element connected to the conductive thin film, the lower antenna ground element extending from the conductive thin film toward a center part of a lower-face member of the body chassis to be connected to the lower-face member, wherein the conductive thin film and the lower antenna ground element define a shield wall for the antenna space.

In the electronic apparatus according to the sixth aspect of the present invention, the lower-face member is a conductive member.

According to the above-described aspects of the present invention, a conductive thin film covering the entire lateral face of the antenna supporting member closer to a center part of the body chassis defines a shield wall for the antenna space. Therefore good receiving characteristics of the antenna unit disposed at the body chassis can be kept and a compact electronic apparatus can be obtained.

DETAILED DESCRIPTION OF THE INVENTION

Figure 1:
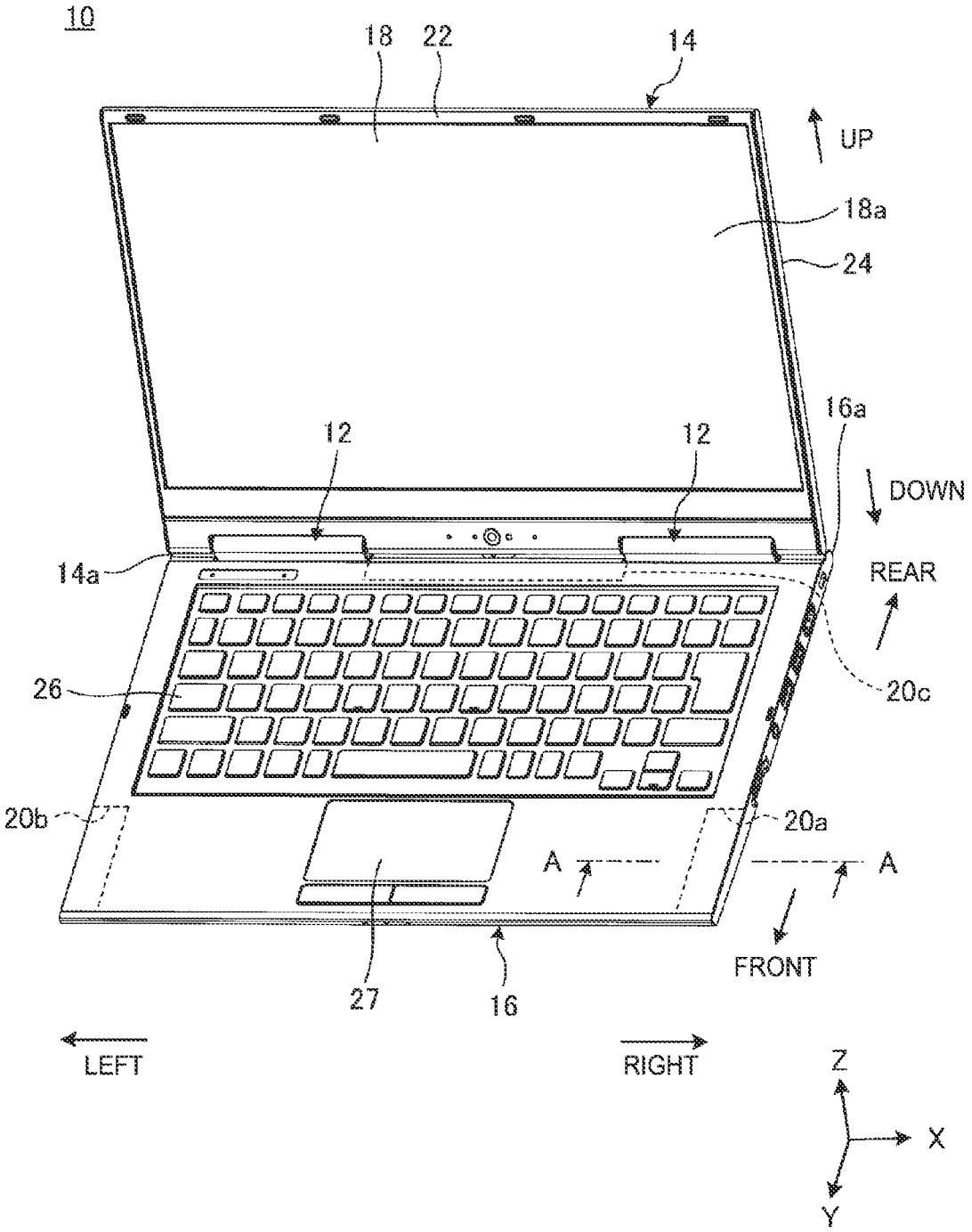
FIG. 1 is a perspective view of an electronic apparatus according to one embodiment of the present invention.

Referring to the drawings, the following describes an electronic apparatus according to the present invention in details by way of a preferable embodiment.

FIG. 1 is a perspective view of an electronic apparatus 10 according to one embodiment of the present invention. FIG. 1 shows the electronic apparatus 10 as a laptop PC during use, in which a display chassis 14 is opened relative to a body chassis 16 via hinge units 12.

The electronic apparatus 10 of the present embodiment is a so-called convertible type PC that can be openable from the 0-degree position to the 360-degree position. At the 0-degree position, the display chassis 14 is closed to the body chassis 16, and at the 360-degree position, the display chassis is flipped. That is, the electronic apparatus 10 can be preferably used as a laptop PC when the display chassis 14 is at an angle of about 90 degrees relative to the body chassis 16 (see FIG. 1). When the display chassis 14 rotates at an angle of 360 degrees relative to the body chassis 16 for flipping, the electronic apparatus 10 can be preferably used as a tablet PC. The present invention can be applied to various types of electronic apparatuses other than such a convertible type PC, including a typical laptop PC having a display chassis that rotates only at about 180 degrees, a tablet PC having one chassis including a display device, a mobile phone, a smartphone, and an electronic organizer.

In the following description, based on the state of FIG. 1 where the display chassis 14 is opened at about 90 degrees relative to the body chassis 16 to use the laptop PC, the direction along the display chassis 14 toward the hinge units 12 is called downward (lower end), and the opposite direction is called upward (upper end). The direction along the body chassis 16 toward the hinge units 12 is called rearward (rear end), and the opposite direction is called forward (front end). The directions along the widths of the display chassis 14 and the body chassis 16 are called the left and the right in the following description.

As shown in FIG. 1, the electronic apparatus 10 is configured to join the lower end 14*a* of the display chassis 14 and the rear end 16*a* of the body chassis 16 rotatably via a pair of left and right hinge units 12, 12.

The display chassis 14 includes a display device 18 therein. The display chassis 14 includes a bezel member 22 and a cover member 24 that are stacked and joined, whereby the display chassis is configured as a flat-plate shaped box that is thinner than the body chassis 16.

The display device 18 includes a touch-panel type liquid crystal display device, for example. The display device 18 has a display face 18*a*, and the other faces of the display device are covered with metal or conductive film.

The bezel member 22 is a frame member made of resin. The bezel member 22 surrounds and holds the periphery of the display device 18. The cover member 24 includes a plate-like member made of resin, and an upright wall from the periphery of the plate-like member toward the bezel member 22. The cover member 24 covers the lateral faces and the rear face of the display chassis 14. The display chassis 14 is joined to the body chassis 16 via the hinge units 12. The hinge units 12 are screwed to the cover member 24. The display chassis 14 is electrically connected to the body chassis 16 via a cable (not illustrated) passing through the hinge units 12.

The body chassis 16 is a flat-plate shaped box. The body chassis has an inner face, on which a keyboard unit 26 and a touch pad 27 are disposed. The body chassis 16 accommodates various types of electronic components not illustrated, such as a board, an arithmetic unit and a memory. The keyboard unit 26 may be a software keyboard to display a virtual keyboard on the touch-panel type liquid crystal display device, for example.

The body chassis 16 internally includes a pair of right and left antenna units 20*a* and 20*b* at a front part of the right end and a front part of the left end, respectively. The body chassis 16 further internally includes an antenna unit 20*c* at a center part of the rear end. The antenna units 20*a* to 20*c* may be antennas for the electronic apparatus 10 to implement various types of wireless communication, such as wireless LAN or a wireless WAN.

Figure 2:
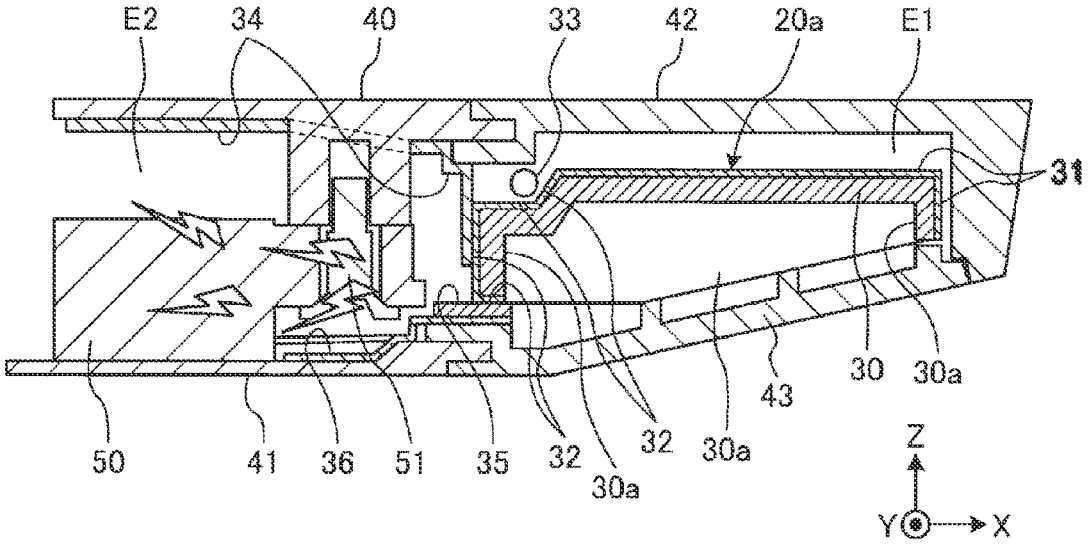
FIG. 2 is a cross sectional view of the antenna unit of FIG. 1, taken along the line A-A.
Figure 3:
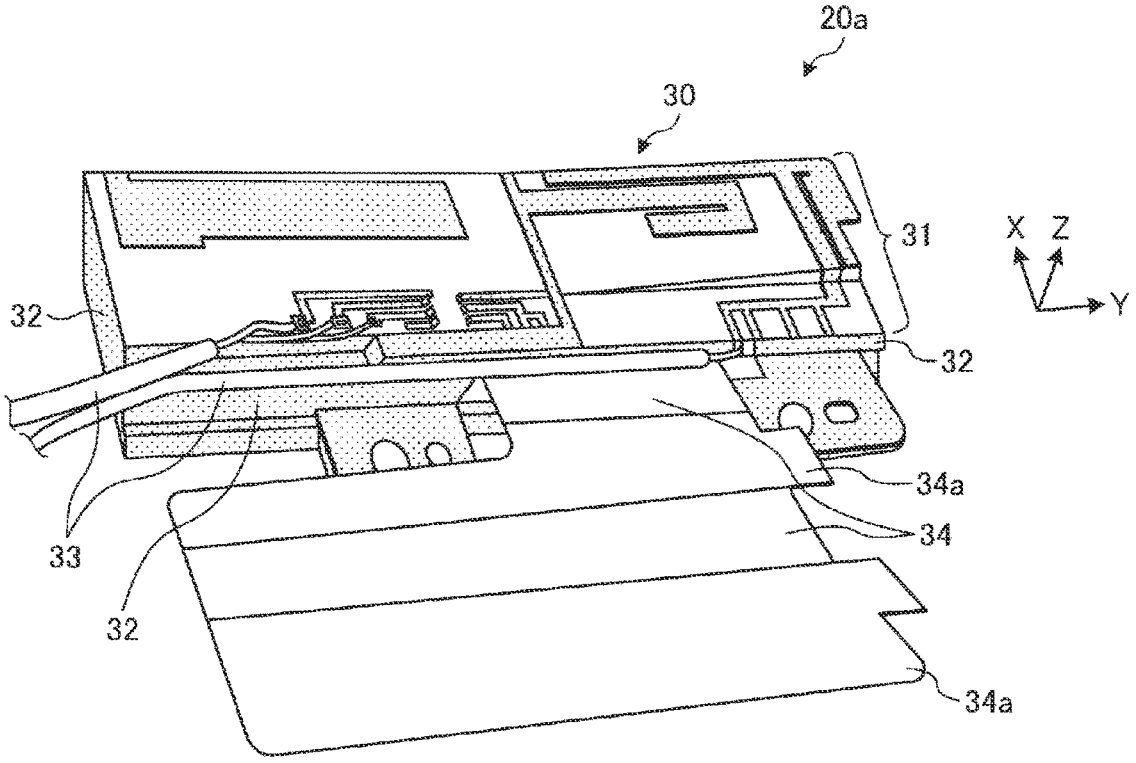
FIG. 3 is a perspective view of the antenna unit of FIG. 1.

The following describes the configuration of the antenna unit 20*a* in details. The other antenna units 20*b* and 20*c* have a similar configuration. FIG. 2 is a cross sectional view of the antenna unit 20*a*, taken along the line A-A. FIG. 3 is a perspective view of the configuration of the antenna unit 20*a*.

As shown in FIG. 2, the body chassis 16 has an electronic-component space E2 in which various types of electronic components 50 are disposed on the motherboard. This space E2 is defined by a keyboard cover member 40 made of metal as an upper-face member and a bottom-face cover member 41 made of metal as a lower-face member. The motherboard with the electronic components 50 disposed thereon is secured to the rear face of the keyboard cover member 40 via a bolt 51. The body chassis 16 has an antenna space E1 at the right periphery. This space is to dispose an antenna, and is defined by a keyboard cover lateral member 42 made of a dielectric material and a bottom-face cover lateral member 43 made of a dielectric material. The antenna unit 20*a* includes an antenna supporting member 30 disposed in the antenna space E1 and an upper antenna ground element 34 and a lower antenna ground element 36 disposed in the electronic-component space E2.

As shown in FIGS. 2 and 3, the antenna supporting member 30 disposed in the antenna space E1 has an upper face, on which an antenna pattern 31 as a conductive pattern is drawn as an antenna element. This antenna pattern 31 forms a plurality of plate-like small inverted F antennas. The antenna supporting member 30 has lateral walls 30*a* to define a recessed portion at its lower center part.

The antenna supporting member 30 has lateral faces toward the center of the body chassis 16, and these lateral faces as a whole are covered with a conductive thin film 32 as a shield pattern. That is, the conductive thin film 32 is formed at the entire lateral faces out of the lateral faces of the lateral walls 30*a* that are closer to the center of the body chassis 16. The lateral faces closer to the center of the body chassis 16 are the lateral face toward −Y direction and −X direction. Note here that X direction is the rightward direction of the body chassis 16, Y direction is the forward direction of the body chassis 16, and Z direction is the upward direction perpendicular to the XY plane. The conductive thin film 32 functions as a shield wall for the antenna space E1.

To the upper part of the conductive thin film 32 in −X direction, the sheet-form upper antenna ground element 34 is connected. The upper antenna ground element 34 extends from the conductive thin film 32 in Z direction, and then extends to the rear face of the keyboard cover member 40. As shown in FIG. 3, the upper antenna ground element 34 is bonded to the rear face of the keyboard cover member 40 via an adhesive layer 34*a* disposed on the rear face of the keyboard cover member 40. The upper antenna ground element 34 and the conductive thin film 32 function as a shield wall for the antenna space E1. The lateral wall 30*a* has a step at a part close to the upper end in −X direction. This step is to guide an antenna cable 33 connected to the antenna pattern 31 and the conductive thin film 32 or the upper antenna ground element 34.

To the lower part of the conductive thin film 32 in −X direction, the sheet-form lower antenna ground element 36 is connected via a conductive gasket 35. The lower antenna ground element 36 extends from the conductive thin film 32 in −X direction, and then is bonded to the rear face of the bottom-face cover member 41. The lower antenna ground element 36 and the conductive thin film 32 function as a shield wall for the antenna space E1. As a result, the conductive thin film 32, the upper antenna ground element 34 and the lower antenna ground element 36 can function as a shield wall for the antenna space E1.

The antenna supporting member 30 of the present embodiment includes the lateral walls 30*a* that are integrally formed. The antenna supporting member 30 is integrally formed as a three-dimensional circuit by laser direct structuring so as to include the antenna pattern 31 and the conductive thin film 32. Manufacturing of a three-dimensional circuit by laser direct structuring begins with injection molding of special plastic for laser direct structuring containing metal catalyst. After that, a part of the molded plastic at which wiring is to be formed, i.e., the antenna pattern 31 and the conductive thin film 32 are to be formed, is irradiated with infrared laser for activation. Then, the activated part is metallized with copper/nickel/gold plating to form wiring. In this way, the three-dimensional structured antenna supporting member 30 including the antenna pattern 31 and the conductive thin film 32 can be obtained.

The above-stated conductive thin film 32, upper antenna ground element 34, and lower antenna ground element 36 function as a shield wall for the antenna space E1, in which the antenna supporting member 30 is to be disposed. This shield wall prevents electromagnetic waves coming from the electronic component 50 in the electronic-component space E2 of the body chassis 16 or coming from the electronic components disposed closer to the lower end 14*a* of the display chassis 14 from transmitting to the antenna supporting member 30 as noise, which can avoid deterioration of the receiving characteristics of the antenna unit 20*a*. Specifically electromagnetic noise for the antenna unit 20*a* can be reduced by 10 dB or more as compared with the configuration without such a shield wall.

Figure 4:
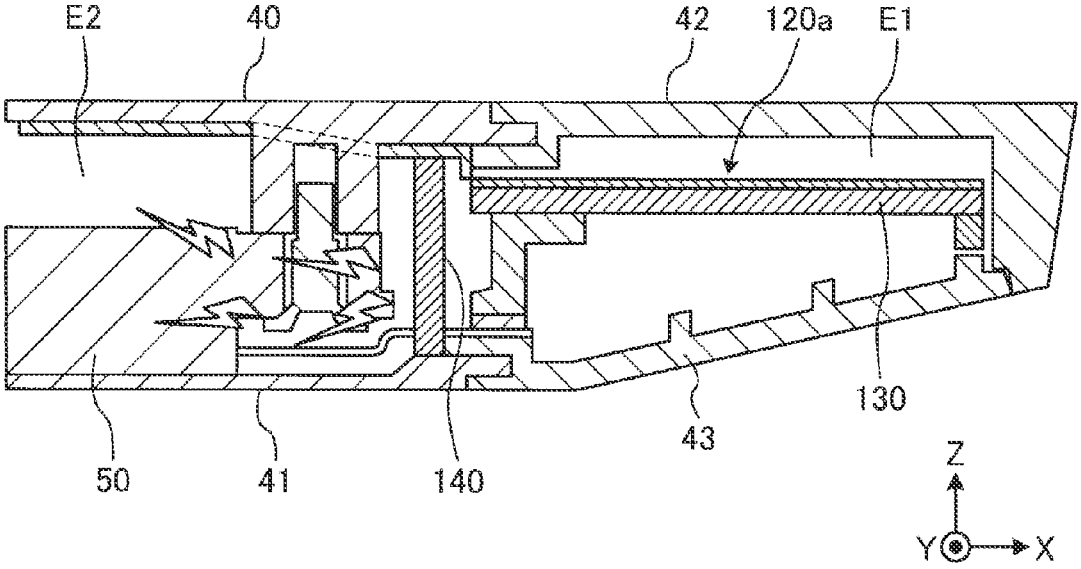
FIG. 4 PRIOR ART
FIG. 4 is a cross-sectional view of the configuration of a conventional electronic apparatus including an antenna unit.

FIG. 4 is a cross-sectional view of the configuration of a conventional antenna unit body 120*a* including a shield wall 140 that is separated from the antenna unit body 120*a*. In this case, the antenna unit body 120*a* is disposed in the antenna space E1, and the shield wall 140 has to be separately disposed in the electronic-component space E2 at a part close to the antenna space E1. As a result, the space E2 of this conventional electronic apparatus increases in size because it has to include the shield wall 140, which inhibits the downsizing of the electronic apparatus. On the contrary, the present embodiment is configured so that the conductive thin film 32 corresponding to the shield wall 140 is disposed close to the antenna supporting member 30 as the antenna unit body, and so the electronic-component space E2 does not have to increase in size, which can promote the downsizing of the electronic apparatus 10.

The invention claimed is:

1. An electronic apparatus comprising:

a body chassis that has an upper-face member and a lower-face member that is a conductive member, wherein the upper-face member and the lower-face member define an electronic-component space therebetween, wherein an electronic component is disposed in the electronic-component space;

a dielectric cover that is a periphery of the body chassis and defines an antenna space that communicates with the electronic-component space;

an antenna supporting member is disposed in the antenna space, and has lateral walls and an upper face on which an antenna pattern is formed;

a conductive thin film covering an entire lateral face out of the lateral walls, the entire lateral face facing a center of the body chassis;

a sheet-form upper antenna ground element having an upper planar surface, the sheet-form upper antenna ground element being disposed in the electronic-component space and electrically connected to the conductive thin film, the upper planar surface being affixed to the upper-face member of the body chassis; and a sheet-form lower antenna ground element having a lower planar surface, the sheet-form lower antenna ground element being disposed in the electronic-component space and electrically connected to the conductive thin film, the lower planar surface being affixed to the lower-face member of the body chassis, wherein the conductive thin film, the upper antenna ground element, and the lower antenna ground element define a shield wall for the antenna space.

2. The electronic apparatus according to claim 1, wherein the antenna supporting member is integrally formed as a three-dimensional circuit so as to include the antenna pattern on the upper face and the conductive thin film on the lateral face.

* * * * *